US007556332B2

(12) United States Patent
Sakamoto et al.

(10) Patent No.: US 7,556,332 B2
(45) **Date of Patent: *Jul. 7, 2009**

(54) RECORDING HEAD AND RECORDING APPARATUS

(75) Inventors: Atsushi Sakamoto, Kawasaki (JP); Hirokazu Tanaka, Ohta-ku (JP); Jiro Moriyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/957,120

(22) Filed: Dec. 14, 2007

(65) Prior Publication Data

US 2008/0100650 A1 May 1, 2008

Related U.S. Application Data

(63) Continuation of application No. 11/427,210, filed on Jun. 28, 2006, now Pat. No. 7,318,635.

(30) Foreign Application Priority Data

Jul. 6, 2005 (JP) ..... 2005-197559

(51) Int. Cl.
*B41J 2/205* (2006.01)

(52) U.S. Cl. ..... 347/15; 358/1.9

(58) Field of Classification Search ..... 347/15, 347/43, 19, 12, 14, 40; 358/1.2, 1.9, 3.23, 358/1.13, 1.16

See application file for complete search history.

(56) References Cited

U.S. PATENT DOCUMENTS 5,914,731 A * 6/1999 Yano et al. ..... 347/9
6,690,485 B1 * 2/2004 Borrell et al. ..... 358/1.9
7,318,635 B2 * 1/2008 Sakamoto et al. ..... 347/15

FOREIGN PATENT DOCUMENTS

JP 07-052338 A 2/1995

* cited by examiner

*Primary Examiner*—Lamson D Nguyen
(74) *Attorney, Agent, or Firm*—Canon U.S.A., Inc., IP Division

(57) ABSTRACT

A recording apparatus performs a recording operation with a recording head that includes a recording element having two types of discharge characteristics, and a memory holding k-bit information indicating a rank of the discharge characteristic of the recording element and j-bit information, where j and k has a relationship of k>j, indicating a difference from the k-bit information. The recording apparatus includes an acquiring unit to acquire the k-bit information and the j-bit information, a selection unit to select driving parameters of one of the two types of the recording elements based on the k-bit information, and select the driving parameters of the other of the two types of the recording elements based on the k-bit information and the j-bit information, and a control unit to control a driving of the recording head based on the driving parameters selected by the selection unit.

3 Claims, 9 Drawing Sheets

| | 5pl | | | | | | | 2pl | | | | | |
|---|---|---|---|---|---|---|---|---|---|---|---|---|---|
| | Single | | | Double | | | | Single | | | Double | | |
| Rank No. | Pre | Interval | Main | Pre | Interval | Main | Rank No. | Pre | Interval | Main | Pre | Interval | Main |
| 0 | – | – | 0.465 | 0.169 | 1.058 | 0.381 | 0 | – | – | 0.465 | 0.148 | 1.058 | 0.402 |
| 1 | – | – | 0.486 | 0.169 | 1.036 | 0.381 | 1 | – | – | 0.486 | 0.148 | 1.036 | 0.423 |
| 2 | – | – | 0.508 | 0.169 | 1.015 | 0.402 | 2 | – | – | 0.508 | 0.148 | 1.015 | 0.423 |
| 3 | – | – | 0.529 | 0.169 | 0.994 | 0.423 | 3 | – | – | 0.529 | 0.169 | 0.994 | 0.444 |
| 4 | – | – | 0.550 | 0.169 | 0.973 | 0.444 | 4 | – | – | 0.550 | 0.169 | 0.973 | 0.465 |
| 5 | – | – | 0.571 | 0.190 | 0.952 | 0.465 | 5 | – | – | 0.571 | 0.169 | 0.952 | 0.486 |
| 6 | – | – | 0.592 | 0.190 | 0.931 | 0.486 | 6 | – | – | 0.592 | 0.169 | 0.931 | 0.486 |
| 7 | – | – | 0.613 | 0.190 | 0.909 | 0.486 | 7 | – | – | 0.613 | 0.190 | 0.909 | 0.508 |
| 8 | – | – | 0.635 | 0.190 | 0.888 | 0.508 | 8 | – | – | 0.635 | 0.190 | 0.888 | 0.529 |
| 9 | – | – | 0.656 | 0.190 | 0.888 | 0.529 | 9 | – | – | 0.656 | 0.190 | 0.867 | 0.550 |
| 10 | – | – | 0.677 | 0.190 | 0.867 | 0.550 | 10 | – | – | 0.677 | 0.190 | 0.846 | 0.571 |
| 11 | – | – | 0.698 | 0.190 | 0.846 | 0.571 | 11 | – | – | 0.698 | 0.190 | 0.825 | 0.592 |
| 12 | – | – | 0.698 | 0.190 | 0.825 | 0.592 | 12 | – | – | 0.698 | 0.190 | 0.804 | 0.613 |
| 13 | – | – | 0.719 | 0.169 | 0.804 | 0.613 | 13 | – | – | 0.719 | 0.169 | 0.783 | 0.635 |
| 14 | – | – | 0.740 | 0.169 | 0.783 | 0.635 | 14 | – | – | 0.740 | 0.169 | 0.761 | 0.677 |
| 15 | – | – | 0.761 | 0.148 | 0.783 | 0.677 | 15 | – | – | 0.761 | 0.148 | 0.761 | 0.698 |
| 16 | – | – | 0.783 | 0.148 | 0.761 | 0.698 | 16 | – | – | 0.783 | 0.148 | 0.740 | 0.719 |
| 17 | – | – | 0.804 | 0.148 | 0.740 | 0.719 | 17 | – | – | 0.804 | 0.127 | 0.719 | 0.761 |
| 18 | – | – | 0.825 | 0.127 | 0.719 | 0.740 | 18 | – | – | 0.825 | 0.127 | 0.698 | 0.783 |
| 19 | – | – | 0.846 | 0.106 | 0.698 | 0.783 | 19 | – | – | 0.846 | 0.106 | 0.677 | 0.804 |
| 20 | – | – | 0.867 | 0.106 | 0.677 | 0.804 | 20 | – | – | 0.867 | 0.106 | 0.656 | 0.846 |
| 21 | – | – | 0.888 | 0.085 | 0.677 | 0.846 | 21 | – | – | 0.888 | 0.085 | 0.635 | 0.867 |
| 22 | – | – | 0.909 | 0.085 | 0.656 | 0.867 | 22 | – | – | 0.909 | 0.063 | 0.635 | 0.909 |
| 23 | – | – | 0.931 | 0.063 | 0.635 | 0.909 | 23 | – | – | 0.931 | 0.042 | 0.613 | 0.931 |
| 24 | – | – | 0.952 | 0.042 | 0.613 | 0.931 | 24 | – | – | 0.952 | 0.042 | 0.592 | 0.973 |
| 25 | – | – | 0.973 | 0.042 | 0.592 | 0.973 | 25 | – | – | 0.973 | 0.021 | 0.571 | 1.015 |
| 26 | – | – | 0.994 | 0.021 | 0.592 | 0.994 | 26 | – | – | 0.994 | 0.021 | 0.550 | 1.036 |
| 27 | – | – | 1.015 | 0.021 | 0.592 | 1.036 | 27 | – | – | 1.015 | 0.021 | 0.550 | 1.079 |
| 28 | – | – | 1.036 | 0.021 | 0.592 | 1.079 | 28 | – | – | 1.036 | 0.021 | 0.529 | 1.121 |
| 29 | – | – | 1.058 | 0.021 | 0.592 | 1.100 | 29 | – | – | 1.058 | 0.021 | 0.508 | 1.142 |
| 30 | – | – | 1.079 | 0.021 | 0.592 | 1.142 | 30 | – | – | 1.079 | 0.021 | 0.486 | 1.184 |
| 31 | – | – | 1.100 | 0.021 | 0.592 | 1.184 | 31 | – | – | 1.100 | 0.021 | 0.465 | 1.227 |

FIG.4

| | 5pl | | | | | | | 2pl | | | | | |
|---|---|---|---|---|---|---|---|---|---|---|---|---|---|
| | Single | | | Double | | | | Single | | | Double | | |
| Rank No. | Pre | Interval | Main | Pre | Interval | Main | Rank No. | Pre | Interval | Main | Pre | Interval | Main |
| 0 | – | – | 0.465 | 0.169 | 1.058 | 0.381 | 0 | – | – | 0.465 | 0.148 | 1.058 | 0.402 |
| 1 | – | – | 0.486 | 0.169 | 1.036 | 0.381 | 1 | – | – | 0.486 | 0.148 | 1.036 | 0.423 |
| 2 | – | – | 0.508 | 0.169 | 1.015 | 0.402 | 2 | – | – | 0.508 | 0.148 | 1.015 | 0.423 |
| 3 | – | – | 0.529 | 0.169 | 0.994 | 0.423 | 3 | – | – | 0.529 | 0.169 | 0.994 | 0.444 |
| 4 | – | – | 0.550 | 0.169 | 0.973 | 0.444 | 4 | – | – | 0.550 | 0.169 | 0.973 | 0.465 |
| 5 | – | – | 0.571 | 0.190 | 0.952 | 0.465 | 5 | – | – | 0.571 | 0.169 | 0.952 | 0.486 |
| 6 | – | – | 0.592 | 0.190 | 0.931 | 0.486 | 6 | – | – | 0.592 | 0.169 | 0.931 | 0.486 |
| 7 | – | – | 0.613 | 0.190 | 0.909 | 0.486 | 7 | – | – | 0.613 | 0.190 | 0.909 | 0.508 |
| 8 | – | – | 0.635 | 0.190 | 0.888 | 0.508 | 8 | – | – | 0.635 | 0.190 | 0.888 | 0.529 |
| 9 | – | – | 0.656 | 0.190 | 0.888 | 0.529 | 9 | – | – | 0.656 | 0.190 | 0.867 | 0.550 |
| 10 | – | – | 0.677 | 0.190 | 0.867 | 0.550 | 10 | – | – | 0.677 | 0.190 | 0.846 | 0.571 |
| 11 | – | – | 0.698 | 0.190 | 0.846 | 0.571 | 11 | – | – | 0.698 | 0.190 | 0.825 | 0.592 |
| 12 | – | – | 0.698 | 0.190 | 0.825 | 0.592 | 12 | – | – | 0.698 | 0.190 | 0.804 | 0.613 |
| 13 | – | – | 0.719 | 0.169 | 0.804 | 0.613 | 13 | – | – | 0.719 | 0.169 | 0.783 | 0.635 |
| 14 | – | – | 0.740 | 0.169 | 0.783 | 0.635 | 14 | – | – | 0.740 | 0.169 | 0.761 | 0.677 |
| 15 | – | – | 0.761 | 0.148 | 0.783 | 0.677 | 15 | – | – | 0.761 | 0.148 | 0.761 | 0.698 |
| 16 | – | – | 0.783 | 0.148 | 0.761 | 0.698 | 16 | – | – | 0.783 | 0.148 | 0.740 | 0.719 |
| 17 | – | – | 0.804 | 0.148 | 0.740 | 0.719 | 17 | – | – | 0.804 | 0.127 | 0.719 | 0.761 |
| 18 | – | – | 0.825 | 0.127 | 0.719 | 0.740 | 18 | – | – | 0.825 | 0.127 | 0.698 | 0.783 |
| 19 | – | – | 0.846 | 0.106 | 0.698 | 0.783 | 19 | – | – | 0.846 | 0.106 | 0.677 | 0.804 |
| 20 | – | – | 0.867 | 0.106 | 0.677 | 0.804 | 20 | – | – | 0.867 | 0.106 | 0.656 | 0.846 |
| 21 | – | – | 0.888 | 0.085 | 0.677 | 0.846 | 21 | – | – | 0.888 | 0.085 | 0.635 | 0.867 |
| 22 | – | – | 0.909 | 0.085 | 0.656 | 0.867 | 22 | – | – | 0.909 | 0.063 | 0.635 | 0.909 |
| 23 | – | – | 0.931 | 0.063 | 0.635 | 0.909 | 23 | – | – | 0.931 | 0.042 | 0.613 | 0.931 |
| 24 | – | – | 0.952 | 0.042 | 0.613 | 0.931 | 24 | – | – | 0.952 | 0.042 | 0.592 | 0.973 |
| 25 | – | – | 0.973 | 0.042 | 0.592 | 0.973 | 25 | – | – | 0.973 | 0.021 | 0.571 | 1.015 |
| 26 | – | – | 0.994 | 0.021 | 0.592 | 0.994 | 26 | – | – | 0.994 | 0.021 | 0.550 | 1.036 |
| 27 | – | – | 1.015 | 0.021 | 0.592 | 1.036 | 27 | – | – | 1.015 | 0.021 | 0.550 | 1.079 |
| 28 | – | – | 1.036 | 0.021 | 0.592 | 1.079 | 28 | – | – | 1.036 | 0.021 | 0.529 | 1.121 |
| 29 | – | – | 1.058 | 0.021 | 0.592 | 1.100 | 29 | – | – | 1.058 | 0.021 | 0.508 | 1.142 |
| 30 | – | – | 1.079 | 0.021 | 0.592 | 1.142 | 30 | – | – | 1.079 | 0.021 | 0.486 | 1.184 |
| 31 | – | – | 1.100 | 0.021 | 0.592 | 1.184 | 31 | – | – | 1.100 | 0.021 | 0.465 | 1.227 |

FIG.7

| | DISCHARGE STABILITY IN EACH INK DISCHARGE AMOUNT | FuseROM CAPACITY (bits) | TIME REQUIRED FOR FuseROM CUTTING PROCESSING (IN MANUFACTURING OF 10,000 RECORDING HEADS) |
|---|---|---|---|
| RANK NUMBER DETERMINING METHOD (PRIOR ART) | ○ | 15 bits | 15,000 sec |
| RANK NUMBER DETERMINING METHOD (EXEMPLARY EMBODIMENT) | ○ | 9 bits | 9,000 sec |

RECORDING HEAD AND RECORDING APPARATUS

CROSS REFERENCE TO RELATED APPLICATIONS

This application is a continuation of U.S. application Ser. No. 11/427,210, filed Jun. 28, 2006, which claims the benefit of Japanese Application No. 2005-197559 filed Jul. 6, 2005, which are hereby incorporated by reference herein in their entirety.

BACKGROUND OF THE INVENTION

1. Field of the Invention

The present invention relates to a recording head and a recording apparatus, and more particularly, to a recording head (e.g., print head) capable of discharging two or more types of ink droplets and a recording apparatus (e.g., printer) to control operations of the recording head.

2. Description of the Related Art

In general, inkjet recording apparatuses have low noises and compact bodies, and require relatively low running costs. Accordingly, many inkjet recording apparatuses are widely used as ordinary printers or copying machines.

A thermal energy type recording apparatus can generate bubbles to discharge ink droplets. In such an inkjet recording apparatus, to stably discharge the ink from a recording head, the recording head is equipped with a memory unit that can store the information relating to head characteristics (refer to Japanese Patent Application Laid-open No. 7-52388).

Based on the stored information, the inkjet recording apparatus can select optimum head driving conditions (i.e., driving parameters) from information relating to driving conditions which are prepared beforehand in the inkjet recording apparatus.

Then, the inkjet recording apparatus can control and drive the recording head based on the selected driving conditions with reference to an ambient temperature and/or a recording head temperature.

In general, the manufacturing of discharge elements of a recording head and wiring for the discharge elements is not free from dispersion or errors. The driving conditions for each recording head should be determined considering the dispersion or errors in the manufacturing. The built-in memory unit of the recording head stores information relating to compensation of the driving conditions.

After a recording head is installed on an inkjet recording apparatus, the inkjet recording apparatus can read compensation information from the built-in memory unit of the recording head and can control an operation of the recording head based on the readout information.

Furthermore, recent inkjet recording apparatuses are configured to discharge two or more types of ink droplets, to realize both high-speed printing and high-quality (e.g., photographic quality) printing. For example, a recording head (especially, a color head) includes high-speed printing nozzles that can discharge 10-5 pl (pico-liter) ink droplets and high-quality printing nozzles that can discharge 4-1 pl ink droplets.

However, as described above, according to the conventional inkjet recording apparatus, the built-in memory unit of the recording head stores all of the required information relating to driving conditions that are differentiated for two or more types of ink discharge amounts or for a plurality of colors. Thus, the built-in memory unit of the recording head must have a large memory capacity. As a result, the cost of a recording head increases.

Furthermore, the above-described built-in memory unit of the recording head is, for example, a fuse ROM. The fuse ROM can store desired information based on a combination of cutoff fuses and non-cut fuses.

Therefore, the fuse ROM requires time-consuming processing for cutting fuses in the manufacturing of a recording head. Accordingly, if the amount of stored information increases, the time required for cutting processing will increase correspondingly. As a result, the manufacturing time per recording head becomes longer.

SUMMARY OF THE INVENTION

According to an aspect of the present invention, an embodiment is directed to a recording apparatus configured to perform a recording operation with a recording head that includes a recording element having two types of discharge characteristics, and a memory holding k-bit information indicating a rank of the discharge characteristic of the recording element and j-bit information, where j and k has a relationship of k>j, indicating a difference from the k-bit information. The recording apparatus comprises: an acquiring unit configured to acquire the k-bit information and the j-bit information; a selection unit configured to select driving parameters of one of the two types of the recording elements based on the k-bit information, and select the driving parameters of the other of the two types of the recording elements based on the k-bit information and the j-bit information; and a control unit configured to control a driving of the recording head based on the driving parameters selected by the selection unit.

Further features of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 4 is a table showing various pulse widths (i.e., driving information) corresponding to respective head ranks, according to an exemplary embodiment.

FIG. 7 is a view showing a relationship between a required fuse capacity and time required for cutting processing.

DETAILED DESCRIPTION OF THE EMBODIMENTS

Figure 1:
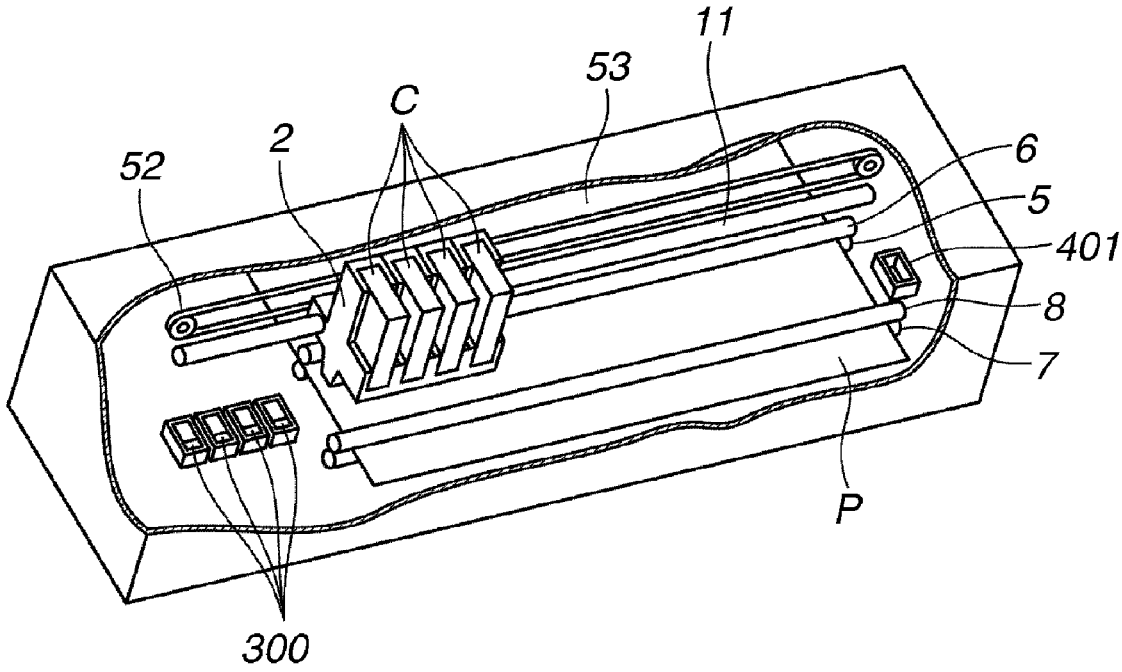
FIG. 1 is a perspective view schematically showing a recording apparatus according to an exemplary embodiment of the present invention.

The following description of exemplary embodiments is merely illustrative in nature and is in no way intended to limit the invention, its application, or uses.

Processes, techniques, apparatus, and materials as known by one of ordinary skill in the art may not be discussed in detail but are intended to be part of the enabling description where appropriate. For example, certain circuitry for signal processing, printing, and others may not be discussed in detail.

However these systems and the methods to fabricate these system as known by one of ordinary skill in the relevant art is intended to be part of the enabling disclosure herein where appropriate.

It is noted that throughout the specification, similar reference numerals and letters refer to similar items in the following figures, and thus once an item is defined in one figure, it may not be discussed for following figures.

Exemplary embodiments will be described in detail below with reference to the drawings.

First Exemplary Embodiment

FIG. 1 is a perspective view showing a recording apparatus in accordance with an exemplary embodiment of the present invention, which includes a recording head performing an inkjet recording operation. As shown in FIG. 1, the recording apparatus includes a plurality of inkjet cartridges (hereinafter, referred to as cartridges) C installable in a carriage 2.

Each inkjet cartridge C includes an ink tank provided at its upper part, a recording head provided at its lower part, and a connector receiving a driving signal for the recording head. The ink tanks of these cartridges C can individually accommodate different color inks, such as yellow, magenta, cyan, and black inks.

Furthermore, the carriage 2 is equipped with a connector holder for transmitting driving signals of the recording heads of respective cartridges C, which can be electrically connected to the recording heads.

According to the example shown in FIG. 1, the carriage 2 can accommodate a total of four cartridges C including ink tanks of different colors, i.e., magenta, yellow, cyan and black colors, from the left.

A scanning rail 11 extends in a main scanning direction of the recording head that can move for scanning. The carriage 2, supported on the scanning rail 11, can slide in the main scanning direction.

A carriage motor 52 can generate a driving force, which is transmitted via a driving belt 53 to the carriage 2 so that the carriage 2 can move in the main scanning direction.

To convey a recording medium P in the apparatus body, conveyor rollers 5, 6, 7 and 8 are provided at predetermined positions in the casing of the recording apparatus.

A pair of conveyor rollers 5 and 6 can press the recording medium P from both sides. Similarly, another pair of conveyor rollers 7 and 8 can press the recording medium P from both sides.

Two of four conveyor rollers 5 through 8 are disposed at the upstream side of a conveyance direction of the recording medium P, with respect to a scanning region of the recording head. The other two conveyor rollers are disposed at the downstream side.

The recording medium P is pressed against a guide surface of a platen (not shown) that regulates a recording face of the recording medium P to be flat.

Furthermore, the recording head of each cartridge C mounted on the carriage 2 is positioned between two conveyor rollers 6 and 8, and protrudes downward from the carriage 2. A discharge port surface, on which discharge ports of the recording head are formed, is opposed and parallel to the recording medium P pressed against the guide surface of the platen (not shown).

The recording apparatus has a recovery unit positioned near a home position of the carriage 2, i.e., at the left side of the recording apparatus body shown in FIG. 1.

As shown in FIG. 1, the recovery unit includes four cap units 300 which can independently move in the up-and-down direction and engage with corresponding recording heads of four cartridges C. Each cap unit 300 can perform capping for an engaged recording head when the carriage 2 is positioned at the home position.

The capping of the cap unit 300 brings an effect of decreasing the amount of ink evaporating from the discharge ports of the recording head, an effect of suppressing increase in the viscosity of ink, or an effect of eliminating evaporation and deposition of volatile components that may cause clogging or other malfunction in the discharge of ink.

Furthermore, the cap unit 300 has a pump unit (not shown) provided in its body. The pump unit can generate a negative pressure, for example, for the suction recovery performed in case of a malfunction of the recording head, in a condition that the cap unit 300 is engaged with the recording head, or at the timing of idle suction for a preparatory ink discharged in a cap of the cap unit 300.

A preparatory discharge receiving portion 401 is provided at the opposite side, i.e., at the right side of the recording apparatus body shown in FIG. 1. A recording operation region for the recording medium P is positioned between the recovery unit (i.e., cap units 300) and the preparatory discharge receiving portion 401.

The recording head can perform a preparatory discharge at the preparatory discharge receiving portion 401.

Furthermore, the recovery unit can include an elastic blade made of a rubber or other elastic member which can wipe droplets of an ink having adhered on a surface of the recording head on which discharge ports are formed. Furthermore, for the purpose of eliminating clogging caused by the wiping of discharge ports, a preparatory discharge for stabilizing the discharge condition can be performed after the wiping is finished.

The recording apparatus of the exemplary embodiment has a common motor that can function as a driving motor conveying the recording medium P and a driving motor moving the recovery unit.

Figure 2:
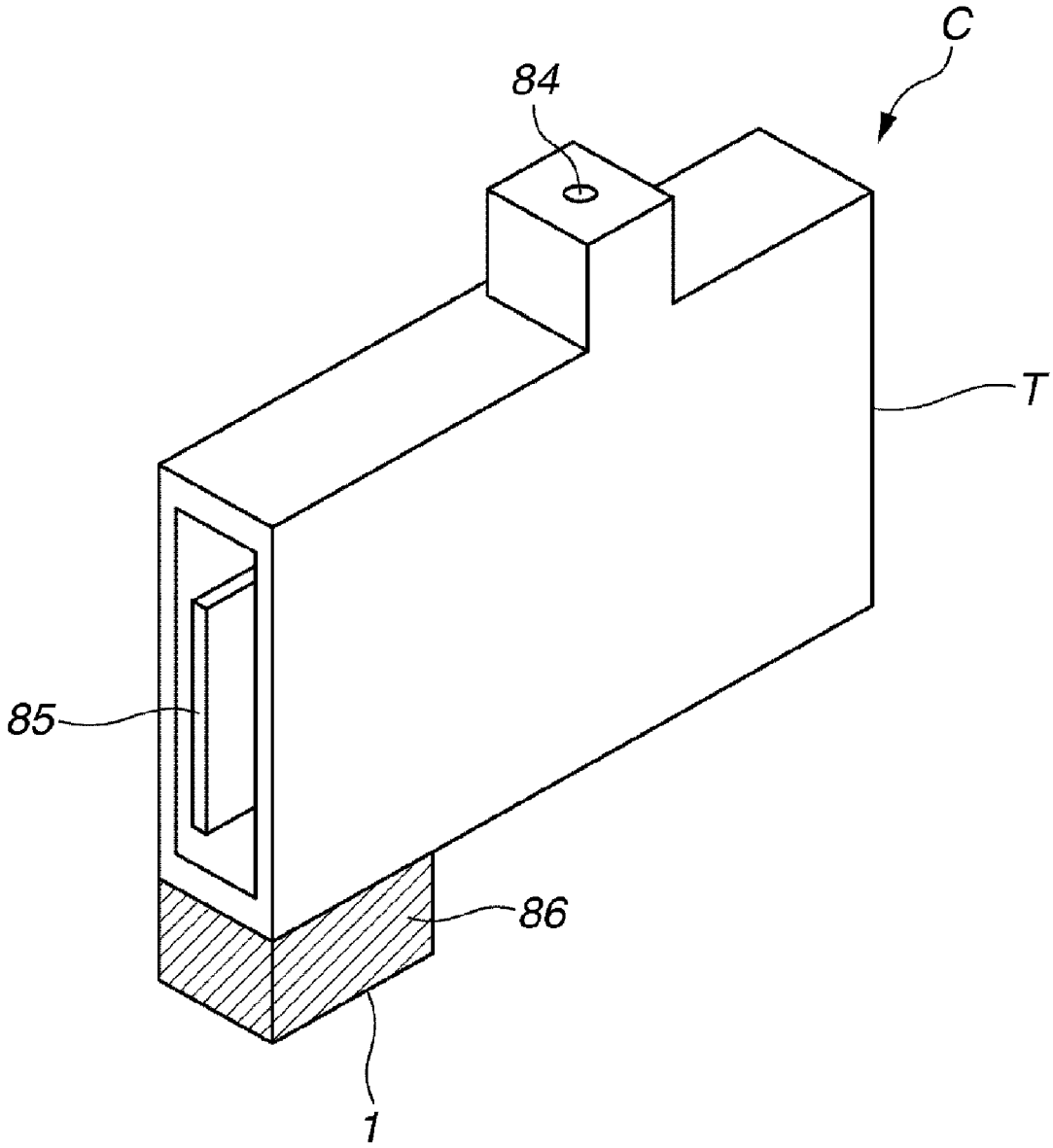
FIG. 2 is a perspective view showing an inkjet cartridge used in the recording apparatus shown in FIG. 1, according to an exemplary embodiment of the present invention.

FIG. 2 is a perspective view showing an exemplary inkjet cartridge C that includes a recording head and an ink tank which are integrated together, according to an embodiment of the present invention. The cartridge C shown in FIG. 2 has an ink tank T provided at its upper part and a recording head 86 at its lower part.

Furthermore, the ink tank T has an air hole 84 provided at the uppermost portion. A connector 85, positioned near the head, is provided on a side surface of the ink tank T. The connector 85 can receive a driving signal of the recording head 86 and output a detection signal representing an ink residual amount.

The recording head 86 has a discharge port surface 1 (i.e., a bottom surface, refer to FIG. 2) on which numerous discharge ports are formed. An electro-thermal transducer, disposed in a liquid passage communicating to each discharge port, can generate thermal energy required for the discharge of an ink.

Figure 3:
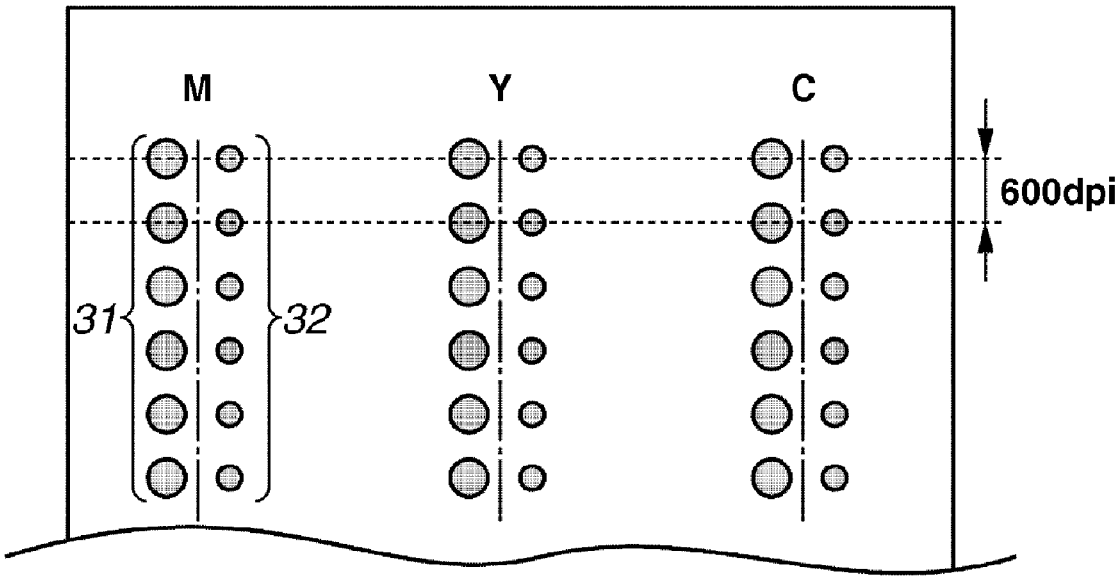
FIG. 3 is a view showing a recording head described in a first exemplary embodiment, seen from its discharging side.

FIG. 3 is a view showing a recording head having three discharge port groups for discharging ink droplets of 3 colors (C, M, and Y), seen from a discharging side, according to a first exemplary embodiment of the present invention. Each discharge port group can discharge two types (e.g., 5 pl and 2 pl) of same color ink droplets. The recording head of FIG. 3 includes an array including linearly aligned nozzles of a first type that can discharge a first discharge amount (5 pl) of ink droplet and another array including linearly aligned nozzles of a second type that can discharge a second discharge amount (2 pl) of ink droplet.

In the exemplary recording head shown in FIG. 3, each discharge port group includes a first nozzle array 31 having linearly aligned discharge ports, each having the capability of discharging a 5 pl of ink droplet. Although not shown in the drawings, each discharge port is equipped with a recording element (hereinafter, referred to as "heater board") that can heat the ink when a voltage is applied. Thus, a predetermined amount of heated ink can be discharged from each discharge port in accordance with the applied voltage.

Each discharge port group further includes a second nozzle array 32 having linearly aligned discharge ports, each having the capability of discharging a 2 pl of ink droplet. Similar to the discharge ports of the first nozzle array 31, each discharge port of the second nozzle array 32 is equipped with a heater board.

The heater board is generally constructed from a semiconductor element, with the size correlating with an ink discharge amount. Therefore, if recording heads are different in size, especially during the manufacturing process of heater boards, their discharge amounts will be different.

Furthermore, a power source provided in the recording apparatus body can supply driving power, via a recording head attaching/detaching portion of the carriage 2, to the recording head. A power source line, supplying electric power to the recording head, will have an adverse effect on the discharge amount of the ink, if the resistance value of the power source line is unstable.

As described above, when the recording heads are different in size which occurs during the manufacturing process of heater boards, or when the resistance of the power source line extending from the power source to the heater board is unstable, ink discharge conditions of manufactured recording heads cannot be equalized to the same values.

In other words, even if a driving voltage and the duration of the applied voltage are carefully controlled to be the same values for manufactured recording apparatuses, discharge conditions (e.g., the ink discharge amount and the ink discharge velocity (rate)) of the manufactured recording apparatuses cannot be equalized to the same values.

Hence, to equalize the discharge conditions (e.g., the ink discharge amount and the ink discharge velocity (rate)) that may be different among manufactured recording heads, the inkjet printers can perform a head driving control considering differences of individual recording heads in the above-described heater board size and wiring resistance (hereinafter, referred to as "head ranks" or "heater ranks").

The heater ranks can be determined as relative values differentiated for a plurality of heater boards. The value representing a heater rank (i.e., a rank number) enables the inkjet printer to acquire optimum driving information corresponding to the heater rank from a driving table prepared beforehand. For example, when the film thickness of each heater board is reduced to downsize the recording head body, the difference in the film thickness becomes a factor determining a heater rank.

FIG. 4 is a table listing practical pulse width information required for a single pulse driving operation as well as practical pulse width information required for a double pulse driving operation, according to an exemplary embodiment of the present invention.

The present exemplary embodiment describes acquirement of pulse width information used in the double pulse driving operation. The pulse width information for a double pulse driving operation is a combined data set of a pre-pulse width (i.e., first ON period), a main pulse width (i.e., second ON period), and an interval (OFF-period) between the pre-pulse and the main pulse.

The present exemplary embodiment allocates a rank number in the process of manufacturing a recording head, with the steps of changing the pulse width applied to each driving group of an inkjet printer to check ink discharge conditions under a constant voltage (which is different from the voltage applied to the apparatus), measuring a pulse width at which the ink starts ejecting from the nozzle, and allocating a rank number (characteristics information) for each recording head based on the measured pulse width.

A storage element (i.e., memory unit) provided in the recording head can store an allocated rank number. When the recording head is installed in an inkjet printer, the inkjet printer can perform a head driving control to select an optimum driving pulse corresponding to the rank number.

According to the recording head including a nozzle array configured to discharge a 5 pl of ink droplets and a nozzle array configured to discharge a 2 pl of ink droplets as shown in FIG. 3, rank numbers were required to be independently allocated to respective nozzle arrays to satisfy desired discharge conditions, prior to the present disclosure.

In this case, the amount of rank number information (i.e., data number) stored in the storage element (i.e., a built-in memory unit) of the recording head is substantially doubled.

Similarly, in the case of a recording head that can discharge three types of ink droplets, the storage element of the recording head was required, prior to the present disclosure, to store a tripled amount of data representing the rank number information so as to satisfy desired discharge conditions.

In general, if a recording head has the capability of discharging a total of N (N is an integer not smaller than 2) types of ink droplets, the storage element of the recording head was required, prior to the present disclosure, to store an increased amount of data equivalent to N times the ordinary rank number information to satisfy desired discharge conditions.

As described above, according to a recording head configured to discharge two or more types of ink droplets, the storage element of the recording head was required, prior to the present disclosure, to store, with respect to the rank number, the information inherent to respective discharge amounts in addition to manufacturing dispersion which can be estimated based on one discharge amount. As a result, minimizing an increase in a required capacity of the storage element was difficult to achieve, prior to the present disclosure.

Figure 5:
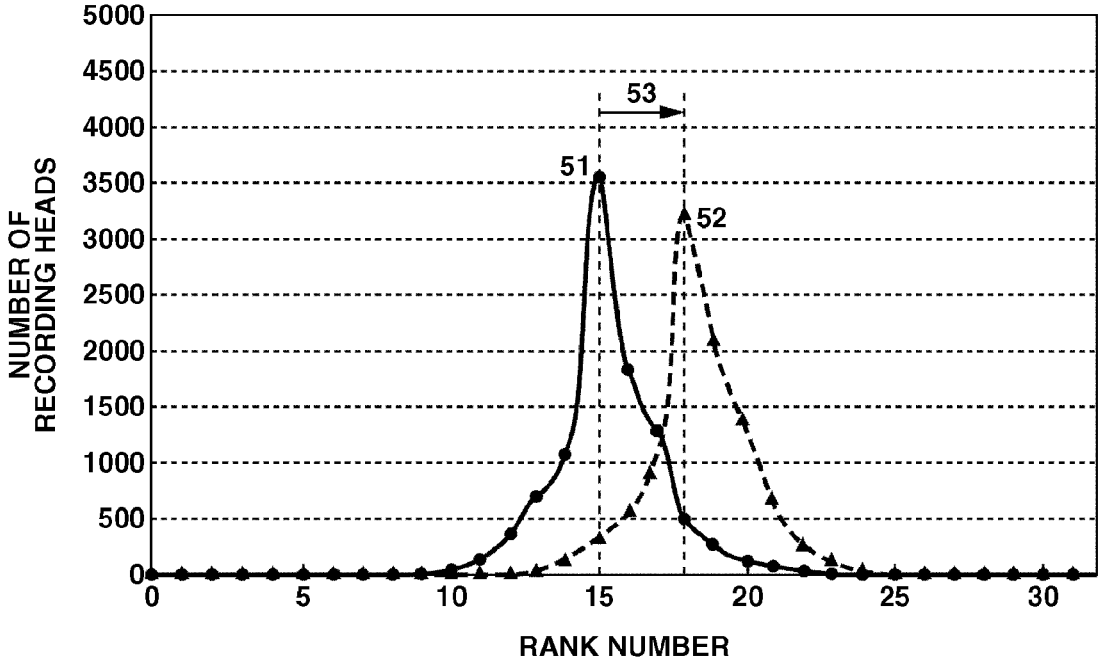
FIG. 5 is a graph showing experimentally obtained distributions of rank numbers obtained from a total of 10,000 recording heads actually manufactured.

FIG. 5 is a graph showing distributions of rank numbers experimentally obtained from a total of 10,000 recording heads which are actually manufactured to have the capability of discharging two types (i.e., 5 pl and 2 pl) of ink droplets.

The resolution of a pulse width per rank is approximately 0.02 μsec (approximately 48 MHz) in each of the nozzles of 5 pl and the nozzles of 2 pl.

In FIG. 5, one distribution 51 shows the rank numbers of the 5 pl nozzle array and another distribution 52 shows the rank numbers of the 2 pl nozzle array.

Each of the distribution 51 and the distribution 52 can be regarded as a normal distribution having a peak at the center and two symmetrical parts monotonously decreasing at both sides of the peak. In this respect, the distribution 51 and the distribution 52 are similar to each other. In other words, the distribution 51 and the distribution 52 have a correlation (i.e., correlated relationship).

The peak of distribution 51 is higher than the peak of distribution 52. The peak of distribution 51 is positioned 3 ranks lower in the rank number than the peak of distribution 52, as indicated by a distance 53 (i.e., a difference in the rank value).

Furthermore, according to measurement results obtained from recording heads having the rank number 15 (identical to the peak of the distribution) with respect to the 5 pl nozzle array, many of the tested recording heads are present in a 4-rank range corresponding to rank numbers 20, 19, 18, and 17 (including a peak rank number 18) with respect to the rank number of the 2 pl nozzle array.

According to similar measurement results obtained from recording heads having the rank number 20 with respect to the 5 pl nozzle array, many of the recording heads are present in a 4-rank range of four consecutive rank numbers including a peak rank number 23 with respect to the rank number of the 2 pl nozzle array.

Furthermore, according to measurement results obtained from recording heads having the rank number 10 with respect to the 5 pl nozzle array, many of the recording heads are present in a 4-rank range of four consecutive rank numbers including a peak rank number 13 with respect to the rank number of the 2 pl nozzle array.

Hence, the present exemplary embodiment uses the above-described correlation in storing rank number information (nozzle driving information) in the built-in memory unit (storage unit) of a recording head. However, the present exemplary embodiment does not require the built-in memory unit to store the rank number information for each of two nozzle types.

In the present exemplary embodiment, the built-in memory unit of the recording head stores the rank number information of only one nozzle type (i.e., 5 pl nozzle array). Regarding the other nozzle type (i.e., 2 pl nozzle array), the built-in memory unit of the recording head stores other information relating to manufacturing dispersion or errors, as described later.

In other words, with respect to driving information of one nozzle type, the present exemplary embodiment selects desired rank information from the entire driving control range (corresponding to a total of L rank numbers) and stores the selected rank information in the memory unit.

Meanwhile, with respect to driving information of the other nozzle type, the present exemplary embodiment selects desired rank information from a predetermined limited driving control range (corresponding to a total of S rank numbers, wherein L>S) and stores the selected rank information in the memory unit. According to the above-described example, L=32 and S=4.

The present exemplary embodiment performs designation (settings) of the predetermined limited driving control range with reference to a deviation (i.e., distance 53 shown in FIG. 5) between two peaks of two distributions 51 and 52. In this case, the deviation can be referred to as rank difference information or first offset amount, or first shift amount.

The deviation between two peaks of two distributions 51 and 52 reflects a difference in discharge characteristics between two nozzle types. According to the above-described example, a 3-rank width representing a peak-to-peak difference of two rank distributions reflects a difference in discharge characteristics between two nozzle types.

Furthermore, in addition to the difference in discharge characteristics, the present exemplary embodiment takes manufacturing dispersion or errors into consideration. In the above-described exemplary distribution of the 2 pl nozzle array, four consecutive rank numbers reflects a dispersion range.

It can be said that the recording heads, if residing in the dispersion range, can satisfy predetermined (required) ink discharge conditions. For example, even in a case that the rank number of the 5 pl nozzle array is 15 and the rank number of the 2 pl nozzle array is 23 (i.e., a rare case as understood from the distribution of FIG. 5), a predetermined amount of ink can be discharged by selecting "20" from the above-described 4-rank range of the 2 pl nozzle array.

The present exemplary embodiment uses an adjustment value that reflects the dispersion range. In this case, the adjustment value can be referred to as second offset amount or second shift amount.

A rank number determining method, according to which a required capacity of the above-described storage element of the recording head can be reduced, will be described below based on an example employing a fuse ROM as the storage element of the recording head (cartridge).

As shown in FIG. 4, the 5 pl nozzle has a main pulse width of 0.46 μSec to 1.1 μSec in a single pulse driving operation. When the dispersion in the manufacturing of the 5 pl nozzle array is taken into consideration, a total of 32 ranks (numbered 0 through 31) can be set. The capacity required for actual allocation of 32 ranks is 5 bits when a fuse ROM is used.

The rank number of the 5 pl nozzle array directly corresponds to a selection number for the head driving pulse of an inkjet printer. When the rank number of the 5 pl nozzle array is 15, the inkjet printer can select a head driving pulse so as to correspond to the rank number.

As described above, the fuse ROM provided in the recording head stores rank numbers of the 5 pl nozzle array. On the other hand, the fuse ROM does not store any rank number of the 2 pl nozzle array. Instead, a memory unit provided in the recording apparatus stores the first offset amount as the information relating to the rank number of the 2 pl nozzle array. The fuse ROM provided in the recording head stores the second offset amount. In this manner, the information relating to the 2 pl nozzle array is separately stored in the recording apparatus and in the recording head. An information amount of information which indicates first offset amount is less than an information amount of information which indicates the rank number of the 5 pl nozzle array.

As described above, the built-in memory unit of the recording apparatus stores the information relating to the correlation which reflects the difference in discharge characteristics between the 5 pl nozzle array and the 2 pl nozzle array. This enables an appropriate use of a fuse ROM having a smaller memory capacity.

The internal memory unit of the recording apparatus stores, as driving information for a recording head, two kinds of tables shown in FIG. 4, i.e., a table listing a plurality of pulse width data applied to the 5 pl nozzle array and a table listing a plurality of pulse width data applied to the 2 pl nozzle array.

The above-described rank number, first offset amount, and second offset amount are values corresponding to a difference in address of the table. In other words, accessing the table is feasible by using these values as a pointer. [Moved to paragraph 101]

As a result, the rank number of the 2 pl nozzle array can be determined based on the calculation (addition) using the rank number X, the first offset amount Y, and the second offset amount Z applied to the 5 pl nozzle array. Thus, the pulse width information applied to the 2 pl nozzle array can be obtained based on the calculated rank number.

To facilitate a thorough understanding of the first exemplary embodiment, suppose, for example, the first offset amount of "3" is set for a recording head installed in the recording apparatus. Additionally, suppose, for example, there are three recording heads A, B and C, each having rank number, first offset amount and second offset amount as follows. In the following description, "X" represents the rank number X, "Y" represents the first offset amount Y, and "Z" represents the second offset amount Z.

As indicated above, the recording heads A, B and C have the same first offset amount Y of 3 (i.e., Y=3). The recording head A has the rank number X of 12 (i.e., X=12) and the second offset amount Z of 0 (i.e., Z=0). The recording head B has the rank number X of 12 (i.e., X=12) and the second offset amount Z of 1 (i.e., Z=1). The recording head C has the rank number X of 15 (i.e., X=15) and the second offset amount Z of −1 (i.e., Z=−1)

The pulse width information for a double pulse driving operation can be obtained in the following manner.

First, the present exemplary embodiment obtains pulse width information applied to the 5 pl nozzle array of the recording head A. As the recording head A has a value of 12 in X, the data set in FIG. 4 corresponding to the rank number 12 can be referred to as pulse width information applied to the 5 pl nozzle array of the recording head A. The values referred to in this case are 0.190 μsec representing the pre-pulse driving time, 0.592 μsec representing the main pulse driving time, and 0.825 μsec representing the interval between pre-pulse and main pulse.

Then, the present exemplary embodiment obtains pulse width information applied to the 2 pl nozzle array of the recording head A. As the recording head A has values of 12 in X, 3 in Y, and 0 in Z, the present exemplary embodiment obtains the rank number of 15 (=12+3+0) for the 2 pl nozzle array of the recording head A.

Accordingly, the data set in FIG. 4 corresponding to the rank number 15 can be referred to as pulse width information applied to the 2 pl nozzle array of the recording head A. The values referred to in this case are 0.148 μsec representing the pre-pulse driving time, 0.698 μsec representing the main pulse driving time, and 0.761 μsec representing the interval between pre-pulse and main pulse.

Next, the present exemplary embodiment obtains pulse width information applied to the 5 pl nozzle array of the recording head B. As the recording head B has a value of 12 in X, the procedure for obtaining pulse width information applied to the 5 pl nozzle array is identical to that described for the recording head A.

Then, the present exemplary embodiment obtains pulse width information applied to the 2 pl nozzle array of the recording head B. As the recording head B has values of 12 in X, 3 in Y, and 1 in Z, the present exemplary embodiment obtains the rank number of 16 (=12+3+1) for the 2 pl nozzle array of the recording head B.

Accordingly, the data set in FIG. 4 corresponding to the rank number 16 can be referred to as pulse width information applied to the 2 pl nozzle array of the recording head B. The values referred to in this case are 0.148 μsec representing the pre-pulse driving time, 0.719 μsec representing the main pulse driving time, and 0.740 μsec representing the interval between pre-pulse and main pulse.

Next, the present exemplary embodiment obtains pulse width information applied to the 5 pl nozzle array of the recording head C. As the recording head C has a value of 15 in X, the data set in FIG. 4 corresponding to the rank number 15 can be referred to as pulse width information applied to the 5 pl nozzle array of the recording head C. The values referred to in this case are 0.148 μsec representing the pre-pulse driving time, 0.677 μsec representing the main pulse driving time, and 0.783 μsec representing the interval between pre-pulse and main pulse.

Then, the present exemplary embodiment obtains pulse width information applied to the 2 pl nozzle array of the recording head C. As the recording head C has values of 15 in X, 3 in Y, and −1 in Z, the present exemplary embodiment obtains the rank number of 17 (=15+3−1) for the 2 pl nozzle array of the recording head C.

Accordingly, the data set in FIG. 4 corresponding to the rank number 17 can be referred to as pulse width information applied to the 2 pl nozzle array of the recording head C. The values referred to in this case are 0.127 μsec representing the pre-pulse driving time, 0.761 μsec representing the main pulse driving time, and 0.719 μsec representing the interval between pre-pulse and main pulse.

Accordingly, based on the information stored in the fuse ROM of the recording head installed on the recording apparatus, the present exemplary embodiment can drive three types of recording heads with pulse widths optimized for their characteristics.

The second offset amount Z is any one of −1, 0, 1, and 2, which corresponds to the width of 4 ranks (four addresses) in the table of pulse widths.

If the manufacturing of recording heads is ideal, driving parameters applied to the 2 pl nozzle array will be unequivocally determined based on the first offset amount Y. However, the manufacturing of recording heads is not free from dispersion or errors. As a result, actually manufactured recording heads have individual differences.

From the experimental results, the second offset amount Z has a width equivalent to 4 ranks. Therefore, the driving parameters can be allocated to almost all of manufactured recording heads, although a few recording heads may have largely differentiated characteristics as understood from the distribution shown in FIG. 5.

In other words, the present exemplary embodiment utilizes the slightly differentiated values of the second offset amount Z to correct the first offset amount Y considering the manufacturing dispersion or errors.

Allocation of the second offset amount Z can be carried out in the following manner. As a practical example, when the 5 pl nozzle array has the rank number X of 15 as described above, the rank numbers of the 2 pl nozzle array are present in a range of four rank numbers 20, 19, 18, and 17 including a peak rank number 18.

When the rank number of the 2 pl nozzle array is 20, the present exemplary embodiment allocates 2 (=20−15−3) to the second offset amount Z based on the values of X=15 and Y=3.

When the rank number of the 2 pl nozzle array is 19, the present exemplary embodiment allocates 1 (=19−15−3) to the second offset amount Z. When the rank number of the 2 pl nozzle array is 18, the present exemplary embodiment allocates 0 to the second offset amount Z. When the rank number of the 2 pl nozzle array is 17, the present exemplary embodiment allocates −1 to the second offset amount Z.

In other words, the present exemplary embodiment selects driving values for the first nozzle array based on a first driving table and selection information for the driving values of the first nozzle array, wherein the first driving table includes a plurality of driving values (i.e., driving parameters) applied to the first nozzle array and the selection information is stored in the recording head.

Furthermore, the present exemplary embodiment selects driving values for the second nozzle array based on a second driving table including a plurality of driving values applied to the second nozzle array, selection information for the driving values of the first nozzle array, information relating to differences in the driving characteristics between the first nozzle array and the second nozzle array, and information relating to the dispersion in the driving characteristics of the second nozzle array.

As described above, the present exemplary embodiment enables the built-in storage element of the recording head to store information relating to optimum driving conditions that can satisfy desired ink discharge conditions, based on measurement results of rank distributions of respective ink discharge amounts obtainable in the process of manufacturing the recording heads, without increasing a required storage capacity.

Figure 9:
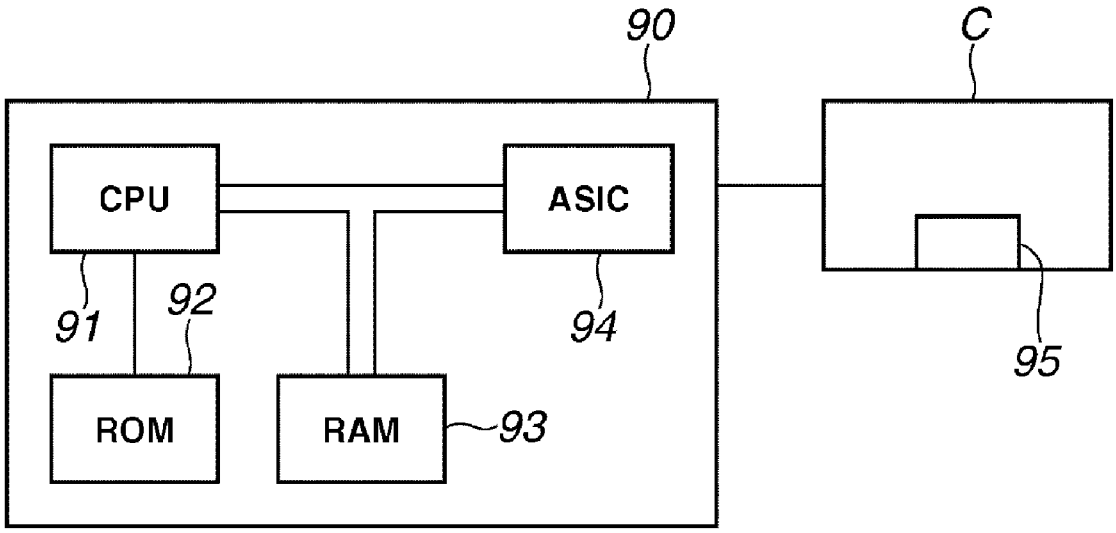
FIG. 9 is a simplified block diagram showing an exemplary control arrangement of the recording apparatus according to an embodiment of the present invention.

FIG. 9 shows an exemplary control arrangement of the recording apparatus. The recording apparatus has a control section 90 that includes CPU 91, ASIC 94, ROM 92, and RAM 93. The CPU 91 can cause the ASIC 94 to execute various operations for controlling the recording apparatus. The ASIC 94 includes a recording head driving control block, a carriage motor control block, and an HV conversion circuit. The ROM 92 can store control program(s) of the CPU 91, tables required for driving the recording head, and information required for controlling the motor. Furthermore, the cartridge C is equipped with a fuse ROM 95.

Figure 8:
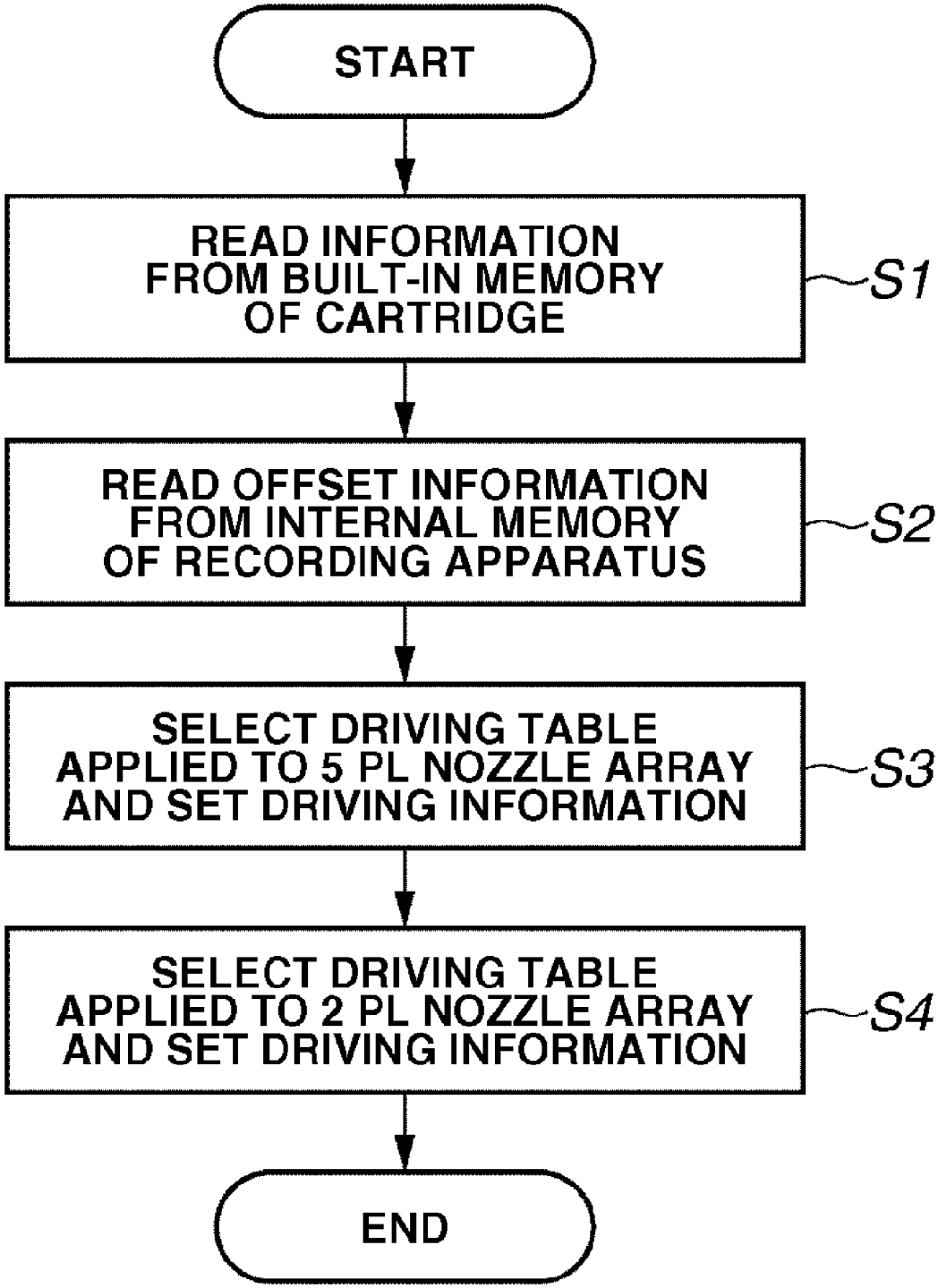
FIG. 8 is a flowchart showing a control procedure performed by a CPU in accordance with an exemplary embodiment.

FIG. 8 is a flowchart showing a control procedure performed by the CPU 91 in accordance with an exemplary embodiment.

In step S1 of the flowchart, the CPU 91 reads the rank number X of the 5 pl nozzle array and the second offset amount Z from the fuse ROM 95 provided in the cartridge C.

In step S2, the CPU 91 reads the first offset amount Y from the ROM 92 of the control section 90.

In step S3, the CPU 91 selects pulse width information applied to the 5 pl nozzle array from the driving table based on the rank number, and sets selected pulse width information in a 5 pl nozzle array setting section of the recording head driving control block.

In step S4, the CPU 91 selects pulse width information applied to the 2 pl nozzle array from the driving table with reference to the rank number X of the 5 pl nozzle array, the first offset amount Y, and the second offset amount Z. The selected pulse width information is set in a 2 pl nozzle array setting section of the recording head driving control block.

Then, in response to a user's operation or an input of image data from an external device, the CPU 91 controls the recording head based on the settings information so as to cause the recording head to perform recording of image on a recording medium.

The above-described control flowchart can be executed, for example, when a power source of the recording apparatus is turned on or when the cartridge is attached to the recording apparatus.

Second Exemplary Embodiment

Compared to the above-described first exemplary embodiment that uses the second offset amount Z to obtain the rank number of the 2 pl nozzle array, the second exemplary embodiment is characterized in that, when the manufacturing dispersion of the 2 pl nozzle array is small, a rank number of the 2 pl nozzle array is obtained based on the rank number X of the 5 pl nozzle array stored in the built-in memory unit of the recording head and the first offset amount Y stored in the internal memory unit of the recording apparatus.

Thus, the second exemplary embodiment is preferably used when the manufacturing dispersion of the 2 pl nozzle array is small. The second exemplary embodiment does not require storing the second offset amount Z in the built-in memory unit of the recording head. By doing so, not only a required memory capacity can be reduced, but also the built-in memory unit of the recording head is available for storing other data.

Third Exemplary Embodiment

According to the second exemplary embodiment, when the manufacturing dispersion of the 2 pl nozzle array is small, a rank number of the 2 pl nozzle array is obtained based on the rank number X of the 5 pl nozzle array stored in the built-in memory unit of the recording head and the first offset amount Y stored in the internal memory unit of the recording apparatus.

The third exemplary embodiment is characterized in that the built-in memory unit of the recording head stores both the rank number X of the 5 pl nozzle array and the first offset amount Y, when the manufacturing dispersion of the 2 pl nozzle array is small.

Fourth Exemplary Embodiment

Compared to the first to third exemplary embodiments which use the recording head including two types of nozzle arrays, the fourth exemplary embodiment is characterized in that the recording head includes three types of nozzle arrays. More specifically, the fourth exemplary embodiment has the following characteristic features different from those of the first exemplary embodiment.

Figure 6:
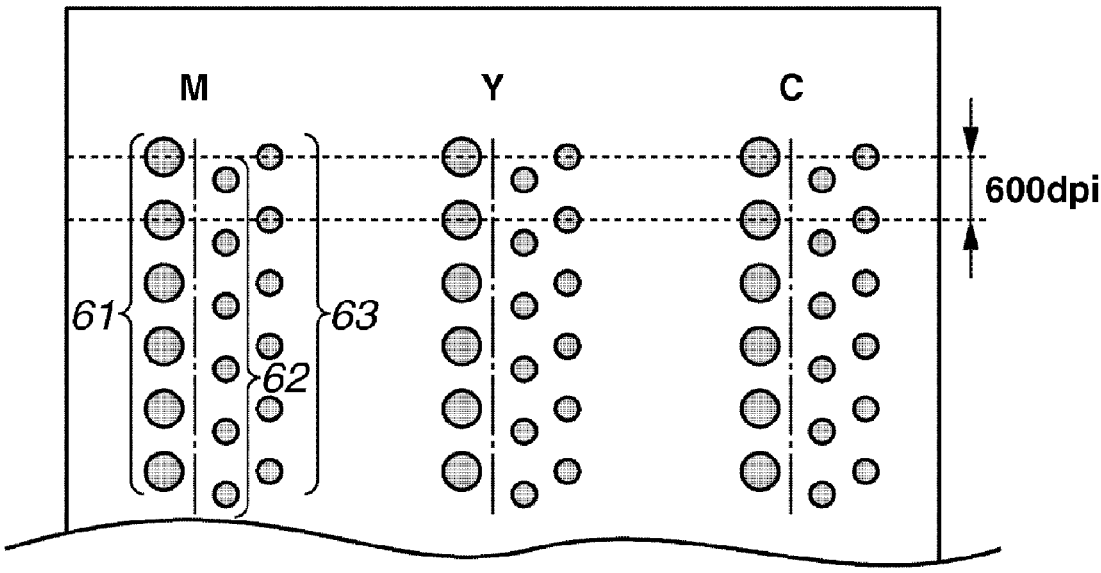
FIG. 6 is a view showing a recording head described in a second exemplary embodiment, seen from its discharging side.

FIG. 6 shows a recording head including a total of three nozzle arrays 61, 62 and 63 whose discharge ports are differentiated in the discharge amount of ink, according to a second exemplary embodiment. The nozzle array 61 includes linearly aligned discharge ports, each having the capability of discharging a 5 pl of ink droplet. The nozzle array 62 includes linearly aligned discharge ports, each having the capability of discharging a 2 pl of ink droplet. The nozzle array 63 includes linearly aligned discharge ports, each having the capability of discharging a 1 pl of ink droplet.

The rank number of the 2 pl nozzle array can be determined based on the first offset amount of "3" relative to the rank number of the 5 pl nozzle array, as described in the first exemplary embodiment. In this case, it is assumed that, in the distribution of rank numbers, almost all heads are present within a 4-rank range including a peak positioned at an offset value.

Furthermore, the rank number of the 1 pl nozzle array can be determined based on a first offset amount of "4" relative to the rank number of the 5 pl nozzle array. In this case, it is assumed that, in the distribution of rank numbers, almost all heads are present within a 4-rank range including a peak positioned at an offset value.

Accordingly, in addition to the features described in the first exemplary embodiment, the fourth exemplary embodiment causes the built-in memory unit of the recording head to store a second offset amount Z2 of the 1 pl nozzle array and causes the internal memory unit of the recording apparatus to store a first offset amount Y2 of the 1 pl nozzle array.

With the above-described arrangement, the fuse ROM can allocate 5 bits to the 5 pl nozzle array, 2 bits to the 2 pl nozzle array, and 2 bits to the 1 pl nozzle array. Thus, the fourth exemplary embodiment can obtain pulse width information applied to the 1 pl nozzle array, without increasing a required capacity of the fuse ROM even when a recording head has three nozzle types.

FIG. 7 shows the comparison between the rank number determining method according to the present exemplary embodiment and the conventional rank number determining method, with respect to three items (i.e., required capacity of fuse ROM, time required for cutting processing, and ink discharge stability of each ink discharge amount) obtained from recording heads having the capability of discharging three types (i.e., 5 pl, 2 pl, and 1 pl) of ink droplets.

Regarding the ink discharge stability of each ink discharge amount, both methods can satisfy desired discharge conditions (i.e., discharge amount and discharge velocity (rate)). Regarding the required capacity of fuse ROM, the conventional method requires 15 bits while the present exemplary embodiment requires 9 bits.

Accordingly, the present exemplary embodiment can reduce a required memory capacity by an amount of approximately 40%. In other words, the memory capacity of the fuse ROM can be efficiently allocated to pulse width information.

Furthermore, in the manufacturing of a total of 10,000 recording heads, the time required for fuse ROM cutting processing was 15,000 seconds (i.e., 0.1 sec/bit×15 bits×10,000) according to the conventional method, and 9,000 seconds according to the method of the present exemplary embodiment. In other words, the present exemplary embodiment can reduce the cutting processing time by an amount of approximately 100 minutes.

Furthermore, reduction in the required storage element capacity and reduction in the fuse ROM cutting processing time can remarkably reduce the costs required in the manufacturing of recording heads.

As described above, the exemplary embodiment of the present invention measures rank number distributions for respective ink discharge amounts in the manufacturing of recording heads having the capability of discharging two or more ink discharge amounts. Then, based on measurement results, the embodiment of the present invention can store the information relating to driving conditions satisfying desired discharge conditions of respective ink discharge amounts, without increasing a required capacity of a storage element provided in the recording head.

Furthermore, when the storage element of the recording head is a fuse ROM, the exemplary embodiment of the present invention can reduce the cutting processing time required for the fuse ROM. As an effect of suppressing increase in a required storage element capacity and reducing a required manufacturing processing time, the embodiment of the present invention can reduce the cost required in the manufacturing of a recording head that is configured to discharge two or more ink droplets. As a result, the embodiment of the present invention can provide a high quality and high-speed inkjet printer at a low cost.

Other Exemplary Embodiment

The present invention is not limited to first through fourth exemplary embodiments. For example, the ink discharge amounts can be four or more types. The second offset amount Z is not limited to four values. Furthermore, when a built-in memory unit of the recording head has a sufficient memory capacity, all of the information relating to the rank number X, the first offset amount Y, and the second offset amount Z can be stored in the built-in memory unit of the recording head.

Furthermore, the driving information for stabilizing the ink discharge conditions is not limited to pulse width information. An embodiment of the present invention can control driving voltages for stabilizing the ink discharge conditions, and can use a table of required driving voltages.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

What is claimed is:

1. A recording apparatus configured to perform a recording operation with a recording head that includes a recording element having two types of discharge characteristics, and a memory holding k-bit information indicating a rank of the discharge characteristic of the recording element and j-bit information, where j and k has a relationship of k>j, indicating a difference from the k-bit information, comprising:

an acquiring unit configured to acquire the k-bit information and the j-bit information;

a selection unit configured to select driving parameters of one of the two types of the recording elements based on the k-bit information, and select the driving parameters of the other of the two types of the recording elements based on the k-bit information and the j-bit information; and a control unit configured to control a driving of the recording head based on the driving parameters selected by the selection unit.

2. A recording method configured to perform a recording operation with a recording head that includes a recording element having two types of discharge characteristics, and a memory holding k-bit information indicating a rank of the discharge characteristic of the recording element and j-bit information, where and k has a relationship of k>j, indicating a difference from the k-bit information, comprising:

an acquiring step configured to acquire the k-bit information and the j-bit information;

a selection step configured to select driving parameters of one of the two types of the recording elements based on the k-bit information, and select the driving parameters of the other of the two types of the recording elements based on the k-bit information and the j-bit information; and a driving step configured to perform driving of the recording head based on the driving parameters selected by the selection unit.

3. A recording head including a recording element having two types of discharge characteristics, and a memory holding k-bit information indicating a rank of the discharge characteristic of the recording element and j-bit information, where j and k has a relationship of k>j, indicating a difference from the k-bit information.

* * * * *